US005774945A

United States Patent [19]

Ginocchio

[11] Patent Number: 5,774,945

[45] Date of Patent: Jul. 7, 1998

[54] BUNDLING DEVICE

[76] Inventor: Mark H. Ginocchio, P.O. Box 4655, St. Petersburg Beach, Fla. 33741

[21] Appl. No.: 769,457

[22] Filed: Dec. 18, 1996

[51] Int. Cl.[6] ..... A44B 21/00; B65D 63/00

[52] U.S. Cl. ..... 24/16 R; 24/18; 24/130; 24/300

[58] Field of Search ..... 24/16 R, 17 B, 24/18, 129 A, 129 B, 129 D, 129 W, 130, 131 C, 300

[56] References Cited

U.S. PATENT DOCUMENTS

| | | | |
|---|---|---|---|
| 268,407 | 12/1882 | Hughes | 24/130 |
| 447,619 | 3/1891 | Miller | 24/18 |
| 551,032 | 12/1895 | Hemphill | 24/130 |
| 565,167 | 8/1896 | Harmon | 24/18 |
| 895,015 | 8/1908 | Hayes | 24/18 |
| 1,052,906 | 2/1913 | Ellis | 24/18 |
| 1,271,895 | 7/1918 | Henry | 24/18 |
| 1,358,476 | 11/1920 | Stout | 24/18 |
| 2,458,252 | 1/1949 | Chatterton | 24/18 |
| 3,310,852 | 3/1967 | Flanders . | |
| 3,429,985 | 2/1969 | Czigler . | |
| 3,574,900 | 4/1971 | Emery | 24/130 |
| 3,654,668 | 4/1972 | Appleton . | |
| 3,910,280 | 10/1975 | Talonn | 128/327 |
| 3,953,911 | 5/1976 | Fishack | 24/16 R |
| 4,278,042 | 7/1981 | Lindquist | 114/218 |
| 4,340,998 | 7/1982 | Liberge | 23/130 |
| 4,361,938 | 12/1982 | Emery | 24/130 |
| 4,380,101 | 4/1983 | Joubert et al. | 24/237 |
| 4,650,925 | 3/1987 | Coldren . | |
| 4,669,688 | 6/1987 | Itoh et al. . | |
| 4,864,695 | 9/1989 | Gold | 24/300 |
| 4,870,722 | 10/1989 | Shell, Jr. . | |
| 4,956,897 | 9/1990 | Speedie | 24/134 P |
| 4,991,265 | 2/1991 | Campbell et al. | 24/16 PB |
| 5,056,248 | 10/1991 | Blanchard . | |
| 5,210,911 | 5/1993 | Brown et al. | 24/18 |
| 5,228,174 | 7/1993 | Beasley | 24/28 |
| 5,317,788 | 6/1994 | Esposito et al. | 24/300 |
| 5,349,779 | 9/1994 | Ben-Dror . | |
| 5,467,507 | 11/1995 | Marsh et al. | 24/300 |

FOREIGN PATENT DOCUMENTS

| | | | |
|---|---|---|---|
| 0265924 | 8/1963 | Australia | 24/130 |

OTHER PUBLICATIONS

*Photograph Gray Cable Clamp* no date is given.
*Photograph Rowland Clip* no date is given.
*Photograph White Cable Clamp* no date is given.

*Primary Examiner*—Victor N. Sakran
*Attorney, Agent, or Firm*—Wood, Herron & Evans, L.L.P.

[57] ABSTRACT

A device (10) for securing together a bundle (26) of objects includes a support member (12) to which a longitudinally stretchable and resilient cord (14) is integrally affixed. The support member includes a handle (24) to facilitate gripping of the device and the bundle in a hand with the device against the bundle. The support member further includes one or more vertical wedges (18, 20) and one or more horizontal wedges (22) for gripping and holding the cord in a wrapped position about the bundle. Each of the vertical wedges includes a pair of generally vertical walls (30) defining a cord-receiving channel (28), and a pair of edges (32) formed in the walls and defining a cord-gripping space between the edges narrower than the unstretched diameter of the cord, the edges engaging and holding the cord in a stretched position. The horizontal wedge includes a C-shaped channel (34) for receiving the cord, the recess being narrower than the unstretched diameter of the cord, and an edge (36) in the C-shaped channel for engaging and holding the cord in a wrapped position.

44 Claims, 4 Drawing Sheets

BUNDLING DEVICE

FIELD OF THE INVENTION

The present invention relates to a device for securing objects together in a bundle.

BACKGROUND OF THE INVENTION number of devices have been proposed for securing objects together in a bundle. One type of bundling device is a "cable tie" made of a nonstretchable material such as nylon and designed to be looped around a bundle of cables and secured to itself in a belt-like fashion. An example of this type of bundling device is shown in U.S. Pat. No. 4,991,265 to Campbell et al., entitled "Cord Tie Device". This device is an elongated tie strap of unitary construction made from a flexible and somewhat resilient plastic. The strap is formed as a succession of strap segments of round cross-section interconnected end-to-end by relatively flat locking disks which are significantly wider than the strap segments. One end of the strap has a locking member selectively engageable with any one of the locking disks. The succession of locking disks provides the capability of securing variously sized bundles. However, the device described in the Campbell patent has a relatively narrow range of adjustability, owing to its relatively short length and the fixed spacing of the locking disks. Furthermore, cable ties of the type described in Campbell are awkward to use, because they provide no convenient means for holding the tie and the cable bundle together as the tie is being looped about the bundle and secured to itself.

The first of these drawbacks to conventional cable ties, namely, the relatively small range of adjustability, has been addressed in U.S. Pat. No. 3,654,668 to Appleton, entitled "Wrapping Device". The device described in Appleton consists of contiguous clips or cleats which hold a longitudinally resilient length of flexible tubing wrapped about a bundle of cables or the like. Each clip or cleat has a pair of troughs and each trough overlies and opens at its bottom into a cylindrical hole oriented with its longitudinal axis parallel to the trough. One end of a length of flexible tubing is forced into one of the troughs until the tubing passes through the opening in the bottom of the trough and snaps into the cylindrical hole. The tubing is then wrapped around a bundle, and the other end of the tubing is forced into the other trough and through the opening in the bottom of the trough until the tubing snaps into the cylindrical hole below that trough. The cylindrical holes have sharp edges at their ends which dig into the tubing to hold it in a stretched position wrapped about a bundle. Thus, the size of the bundle which can be wrapped is limited only by the length of the tubing, and excess tubing can be snipped off.

The Appleton device, however, still suffers from awkwardness of use because, like the Campbell device, it includes no convenient means for holding the cleat or clip and a cable bundle together while the flexible tubing is being forced into one of the troughs and then snapped into the cylindrical hole beneath, wrapped around the bundle, and then forced into the other of the troughs and snapped into the cylindrical hole beneath that trough. Indeed, the cleats or clips shown in Appleton are quite short in length, making them difficult to handle while simultaneously holding a bundle of cables together. Furthermore, with the Appleton device, the flexible tubing can become separated from the cleat during nonuse and one or the other pieces of the device can be lost.

SUMMARY OF THE INVENTION

The present invention provides a bundling device which overcomes the above-mentioned drawbacks associated with prior bundling devices, in which a longitudinally resilient cord is integrally affixed to a support member having structure for gripping and holding the cord in a position wrapped around a bundle. The support member includes a handle adapted to be gripped by the hand of a user. The support member is held by its handle against a bundle to be secured. The cord is then stretched and wrapped around the bundle and support member, and while in its stretched position is secured to the cord-gripping structure. Advantageously, the cord comprises a longitudinally stretchable core covered by a longitudinally stretchable frictional cover. The cord may be any desired length to provide whatever range of adjustability is needed. The cord is easily guided into the cord-gripping structure by virtue of the frictional cover and the design of the cord-gripping structure but, once the cord is engaged in the cord-gripping structure, the cord is held securely without slipping.

The cord-gripping structure advantageously includes at least one wedge integrally formed with the upper surface of the support member. One type of wedge has a pair of generally vertical walls formed with the upper surface of the support member and spaced to define a cord-receiving channel therebetween. The walls have inwardly facing edges oppositely disposed within the channel to define a cord-gripping space therebetween narrower than the unstretched diameter of the cord. Advantageously, the edges define a generally V-shaped space which narrows towards the bottom of the channel. The cord is stretched and guided into the cord-gripping space, and the edges engage the cord and prevent the cord from slipping longitudinally through the cord-gripping space, thereby holding the cord in its wrapped position. The "V" defined by the edges advantageously is inclined relative to vertical, slanting backward toward the bottom narrow end of the V-shaped space, so that tension applied to the cord in a direction which would otherwise tend to loosen the cord actually causes the cord to descend deeper into the V-shaped space and become more firmly engaged therein. However, the cord is easily disengaged from the wedge by applying a slight upward force on the cord. The device may have one such wedge or more than one such wedge, depending upon the desired application.

A second type of wedge has a generally horizontal channel integrally formed with the upper surface of the support member for gripping and holding the cord in a stretched and wrapped position. An upward force on the cord will not dislodge the cord from this horizontal wedge. Thus, engaging the cord in the horizontal wedge ensures that the cord will not become accidentally disengaged if an upward force is inadvertently imposed on the cord. In combination, the vertical wedge or wedges and the horizontal wedge or wedges hold the cord securely even if the cord is subjected to upward and/or horizontal forces. That is, if the force on the cord is horizontal and inadvertently disengages the cord from the horizontal wedge or wedges, the cord will remain secured by the vertical wedge or wedges. Conversely, if the force is upward and inadvertently disengages the cord from the vertical wedge or wedges, the cord will remain secured by the horizontal wedge or wedges.

BRIEF DESCRIPTION OF THE DRAWING

The accompanying drawings, which are incorporated in and constitute a part of this specification, illustrate various embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
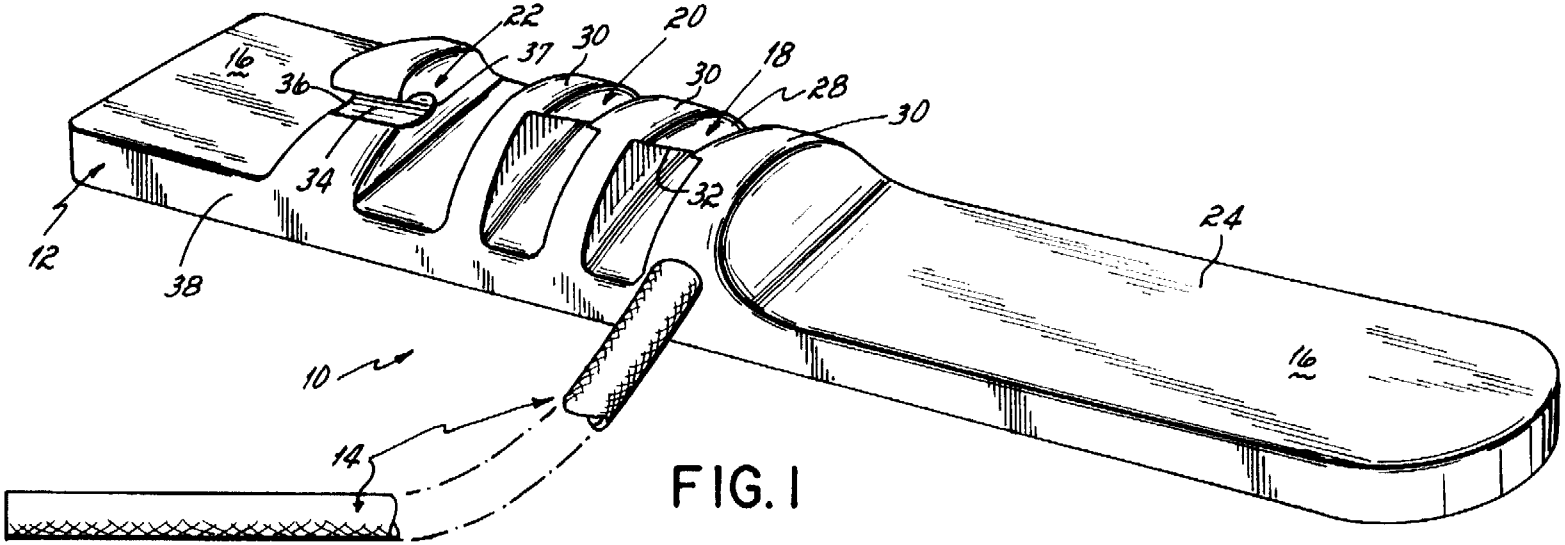
FIG. 1 is a perspective view of a bundling device in accordance with the principles of the present invention.

With reference to FIG. 1, a bundling device 10 in accordance with the principles of the present invention is shown. The device includes a support member 12, and a flexible and longitudinally resilient cord 14 integrally affixed to the support member. The upper surface 16 of member 12 has integrally formed vertical wedges 18 and 20 and an integrally formed horizontal wedge 22, which grip the cord 14 and hold the cord in a stretched position as described in greater detail below. The support member 12 also includes a handle 24 adjacent one end of the support member 12 to facilitate handling of the device during use, as further described below.

Figure 2:
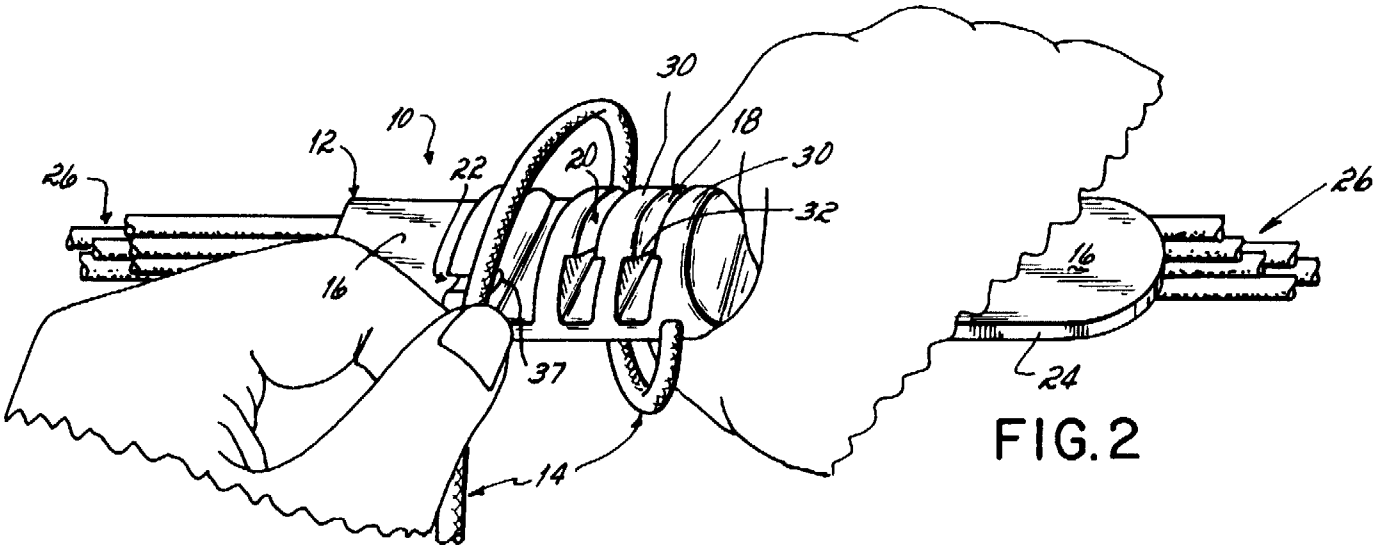
FIG. 2 shows the device of FIG. 1 in use with the cord being wrapped in a first turn about a bundle.
Figure 3:
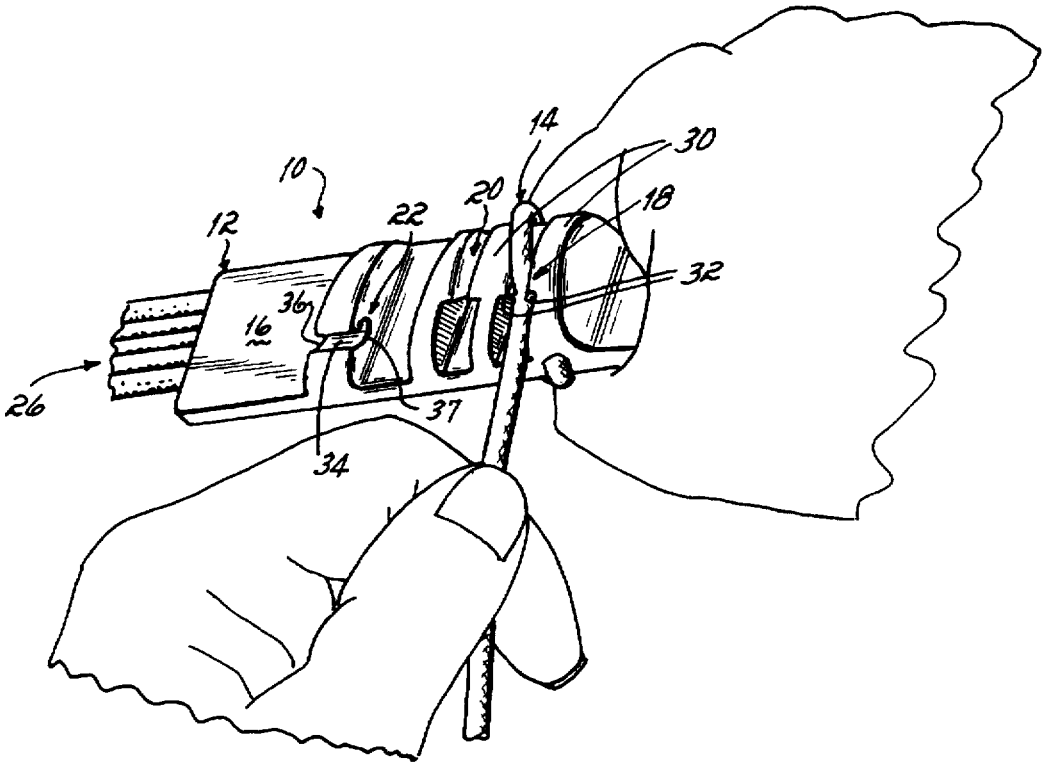
FIG. 3 is a view similar to FIG. 1, showing the cord secured within a vertical wedge after being wrapped once around the bundle.
Figure 4:
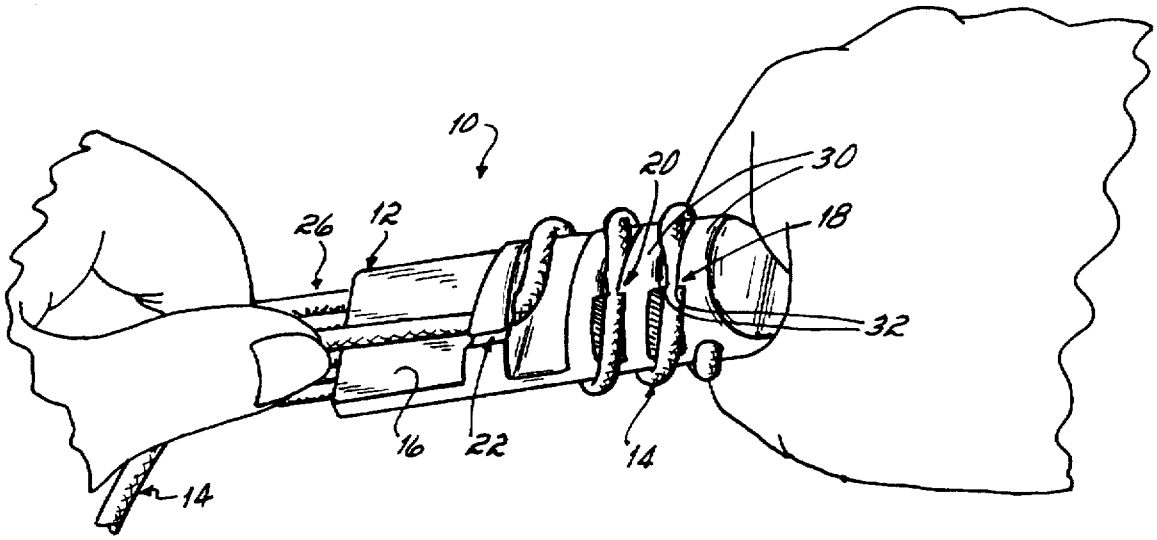
FIG. 4 is a view similar to FIGS. 1 and 2, showing the cord secured within two vertical wedges and secured within the horizontal wedge, having been wrapped three times around the bundle.

FIGS. 2–4 depict the bundling device of FIG. 1 in use. A user grasps a bundle 26 with the hand and places the support member 12 of device 10 adjacent to the bundle with the handle 24 and the bundle 26 grasped together. The term "bundle" as used herein encompasses a plurality of objects to be secured together, multiple overlying segments of a single item such as a cable folded back and forth on itself, or a combination thereof. The user stretches and wraps the cord 14 around the bundle 26 and the support member 12 as shown in FIG. 2. The longitudinal stretching of the cord 14 causes a reduction in its diameter, and the stretched cord 14 is easily guided into the vertical wedge 18 as shown in FIG. 3, where it is prevented from slipping back to a relaxed position by virtue of structure described below. The cord may then be wrapped a second time around the bundle 26 and secured in the vertical wedge 20, and a third time around the bundle 26 and secured in the horizontal wedge 22, as shown in FIG. 4. It should also be noted that the cord 14 may be wrapped around the bundle more than once before securing it in either of the vertical wedges 18 or 20 or the horizontal wedge 22.

Figure 7:
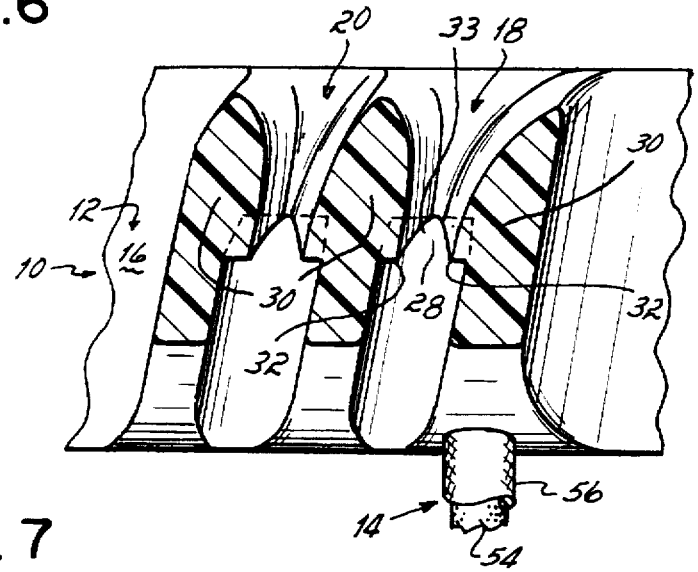
FIG. 7 is a cross-section taken along line 7—7 of FIG. 5, showing the detailed structure of the vertical wedges.
Figure 11A:
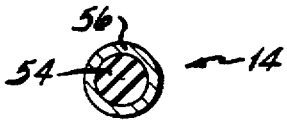
FIG. 11A is a cross-sectional view of a solid-core cord in which the core is of one-piece construction.
Figure 11B:
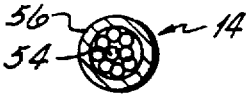
FIG. 11B is a cross-sectional view of a solid-core cord in which the core is constructed of multiple strands.
Figure 11C:
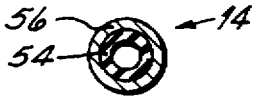
FIG. 11C is a cross-sectional view of a cord in which the core is hollow.

Advantageously, the cord 14 is of the type commonly known as shock cord, such as that sold under the trademark "Bungee", comprising a longitudinally resilient rubber or synthetic polymer core 54 encased in a material sheath or cover 56 (FIG. 7). The cover 56 advantageously is resiliently stretchable material such as but not limited to cotton, rayon, nylon, polypropylene, polyester, or a combination thereof. This construction of cord 14 allows a user to secure cord 14 to one or more of vertical wedges 18, 20 and horizontal wedge 22 with minimal effort. Furthermore, the material cover 56 may be made in various colors and designs for various applications. The core 54 may be solid, either of one-piece construction as shown in FIG. 11A, or composed of a plurality of strands as shown in FIG. 11B. Alternatively, the core 54 may be hollow as shown in FIG. 11C. Stranded-core shock cord suitable for use in the present invention, such as that available from Superior Bungee Corporation of Scottsboro, Ala., has approximately 13 strands in 1/8-inch diameter cord, 42 strands in 3/16-inch diameter cord, 76 strands in 1/4-inch diameter cord, and 100 strands in 5/16-inch diameter cord.

A number of currently available types of shock cord are adequate for use in bundling devices in accordance with the principles of the present invention, including model number 187N1116SU25 cord with a nylon braided cover (3/16-inch diameter) available from Superior Bungee Corporation of Scottsboro, Ala.; model number 23 cord with a polypropylene braided cover (3/16-inch diameter) available from HNW Company of Northvale, N.J.; model number 1003 cord with a polypropylene braided cover (3/16-inch diameter) available from National Cord and Braid Corporation of Fall River, Mass.; and model number SPFX6 cord with a polypropylene braided cover (1/4-inch diameter) available from Bungee International Manufacturing Corporation of Chatsworth, Calif. However, it is to be understood that the stretchability of the core 54, the composition, stretchability and weave of the material cover 56, and the diameter of the cord 14, all may be custom-selected in order to vary the stretchability of the cord 14, the ease with which the cord engages the wedges, the holding power of the cord once engaged in a wedge, and the durability of the cover, depending on the requirements of the particular application.

Because the cord 14 may be engaged in the vertical wedges 18 and 20 and the horizontal wedge 22 at any points along the length of the cord 14, the device 10 provides virtually infinite adjustability. Furthermore, the range of bundle sizes that can be secured is limited only by the length of the cord. Moreover, the support member 12 is easy to manipulate and hold together with a bundle by virtue of the handle 24. Additionally, the integral mounting of the cord 14 within the support member 12 eliminates the necessity of manually holding the end of the cord in a wedge while the cord is being wrapped and stretched. The integral mounting of the cord 14 to support member 12 also prevents the support member 12 and cord 14 from becoming separated from one another during periods of non-use.

Figure 5:
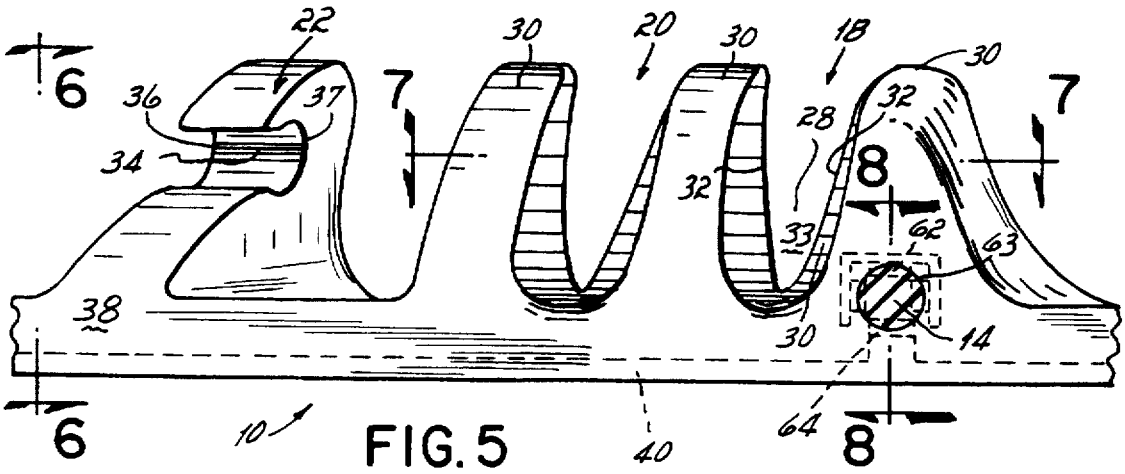
FIG. 5 is a side elevation of an embodiment of a bundling device in accordance with the principles of the invention.

The construction and operation of the vertical wedges 18 and 20 and the horizontal wedge 22 are now described. It will be appreciated that the vertical wedges 18 and 20 are substantially identical, and hence a detailed description of only wedge 18 is provided. With reference to FIGS. 1, 5, and 7, vertical wedge 18 comprises a cord-receiving channel 28 defined by two generally vertical walls 30 integrally formed with upper surface 16 of support member 12. Walls 30 include a pair of edges 32 oppositely disposed within channel 28. The edges 32 define a cord-gripping space 33 therebetween, which space is narrower than the unstretched diameter of the cord 14. Thus, when the cord 14 is stretched so that its diameter is reduced and the cord 14 is guided into the cord-gripping space 33 between the edges 32, the edges 32 engage the cord and prevent it from slipping back through the cord-gripping space. As best shown in FIG. 5, advantageously the edges 32 converge toward the bottom of the channel 28 to form a V-shaped cord-gripping space 33. The "V" defined by the edges 32 advantageously is inclined relative to vertical, slanting backward toward the bottom narrow end of the V-shaped space 33. Thus, once the cord 14 is engaged in the vertical wedge 18, applying tension on the cord 14 in the direction which would otherwise tend to loosen the cord actually causes the cord 14 to become engaged deeper in the V-shaped space 33 and therefore held more firmly. However, a slight upward force will easily disengage the cord 14 from the vertical wedge 18. It is to be understood that although advantageously both of the edges 32 of the device 10 are abrupt edges as depicted in the figures, the wedge 18 would function to hold the cord 14 in a wrapped condition with two non-abrupt or rounded edges, or with one abrupt edge co-acting with a second non-abrupt "edge", which second edge may be smoothly rounded or even a substantially flat portion of the opposite wall 30. Thus, the term "edge" as used herein is not limited to an abrupt edge.

Figure 6:
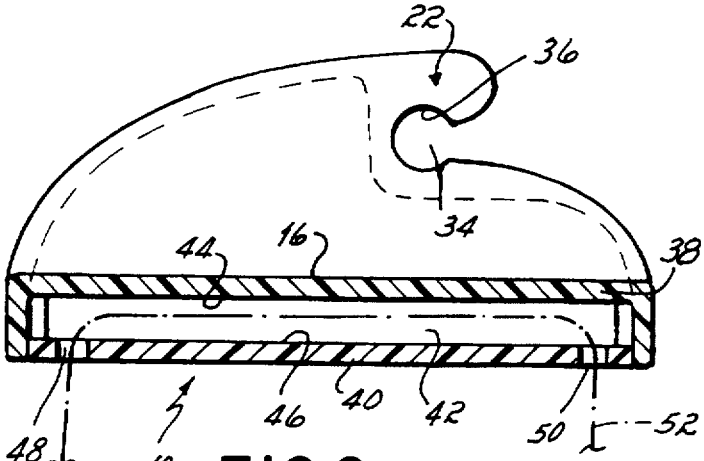
FIG. 6 is a cross-section taken along line 6—6 of FIG. 5, showing an internal passage within the device for receiving a tie wrap.

The horizontal wedge 22 provides additional capability to wrap and secure the cord 14, and further helps prevent inadvertent disengaging of the cord 14. Horizontal wedge 22 comprises a generally horizontal cord-receiving channel 34 integrally formed with the upper surface 16 of support member 12. The channel 34 may be C-shaped in vertical cross-section, as shown in FIG. 6, or alternatively may have a V-shaped structure similar to that of vertical wedges 18 and 20. The wedge 22 includes at least one edge 36 at one end of the channel 34 to engage cord 14 and prevent it from slipping. The width of channel 34 is less than the unstretched diameter of the cord 14. Thus, the cord 14 may be stretched in tension and guided into the channel 34. The edge 36 of the channel 34 engages the cord 14 and prevents it from slipping back through the channel 34 into a relaxed position. The wedge 22 advantageously includes a rounded edge 37 at the opposite end of the channel 34, to permit the cord 14 to be guided more easily into the channel 34. The cord may easily be disengaged from the horizontal wedge 22 by pulling the cord horizontally out of channel 34. However, upward forces on cord 14 will not disengage the cord from the horizontal wedge 22.

Figure 8:
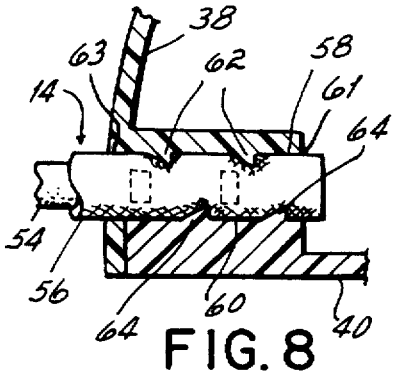
FIG. 8 is a cross-section taken along line 8—8 of FIG. 5, showing the integral mounting of the cord within the device.

FIGS. 5, 6, and 8 illustrate the construction of the device 10. The support member 12 is advantageously formed of a rigid plastic material and is molded in two pieces 38 and 40 which are then joined together. Suitable joining techniques include ultrasonic welding, staking, or gluing. The two-piece construction of support member 12 facilitates the forming of one or more hollow spaces in member 12, which results in material savings. Furthermore, the two-piece construction facilitates the formation of one or more internal passages 42 for receiving a fastener 52 as shown in FIG. 6. Each passage 42 is defined by lower surface 44 of upper member 38 and upper surface 46 of lower member 40. The passage 42 is accessible through openings 48 and 50 in lower member 40. Suitable contouring of passage surfaces 44 and 46 permit the end of a fastener 52 such as a tie wrap, string, or wire to be inserted in opening 48 and threaded through the passage 42 until the end of the fastener emerges from the other opening 50. Advantageously, the device 10 includes one such passage 42 adjacent each end of the support member 12.

The cord 14 is integrally affixed to support member 12 as shown in FIG. 8. The upper member 38 of member 12 includes a recess 58 in its lower surface, and lower member 40 includes a corresponding recess 60 in its upper surface. When upper and lower members 38 and 40 are joined together, recesses 58 and 60 mate to define a hole 61 at least a portion of which is smaller in diameter than cord 14. The hole 61 is accessible through an opening 63 in upper member 38. Recess 58 includes pressure tabs 62, and recess 60 includes pressure tabs 64. The end of cord 14 is inserted through the opening 63 in upper member 38 so that the cord is lying in the recess 58, and members 38 and 40 are then joined. Thus, the cord 14 is compressed between pressure tabs 62 and 64, and the pressure tabs prevent the cord from being withdrawn from the hole 61.

In use, the independent vertical wedges 18, 20 and horizontal wedge 22 of bundling device 10 allow a user to secure a bundle with a single wrap of cord 14 secured to any wedge. Additionally, the user may further bundle with multiple wraps of cord 14 using any of wedges 18, 20 and 22. Also, a larger bundle may be subdivided into two or more smaller bundles, with each smaller bundle being secured by a wrap of cord 14, so that a sub-bundle may be removed by undoing the wrap about that sub-bundle without disturbing the remainder of the bundle. The longitudinal resilience of the cord 14 also makes the device 10 self-adjusting; thus, for example, a portion of a bundle may be removed and the cord 14 will automatically adjust to snugly secure the remaining portion of the bundle.

Furthermore, the handle 24 permits easy manipulation of the device 10 together with a bundle to be secured, allowing a user to hold the device 10 and the bundle with one hand. The upper surface 16 of upper member 38, as well as the lower surface of lower member 40, further provide suitably flat surfaces for embossing or labeling with indicia via hot stamping, pad printing, and the like. The integral mounting of cord 14, moreover, facilitates stretching and wrapping of cord 14 without having to first secure an end of the cord to the device, and prevents separation of the cord and support member during nonuse.

Figure 9:
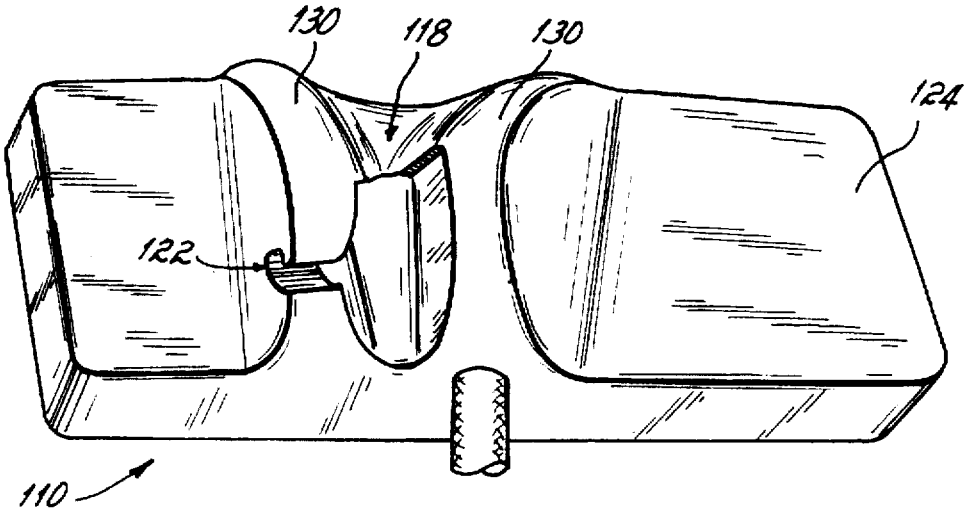
FIG. 9 is a perspective view of an alternative embodiment of a bundling device in accordance with the principles of the present invention.

FIG. 9 shows an alternative embodiment of a bundling device 110 in accordance with the principles of the present invention. The device 110 includes a single vertical wedge 118 formed by walls 130, a horizontal wedge 122, and a handle 124. The horizontal wedge 122 is incorporated in one of the walls 130. The combination of the vertical wedge 118 and horizontal wedge 130 within a single pair of walls 130 makes the device 110 particularly suitable for applications in which it is desirable to reduce the size of the bundling device as much as possible. Although not depicted in FIG. 9, the device 110 may further have a horizontal wedge in the other of the walls 130, so that the cord 114 may be routed in either direction and engaged in either horizontal wedge after being engaged in the vertical wedge 118.

Figure 10:
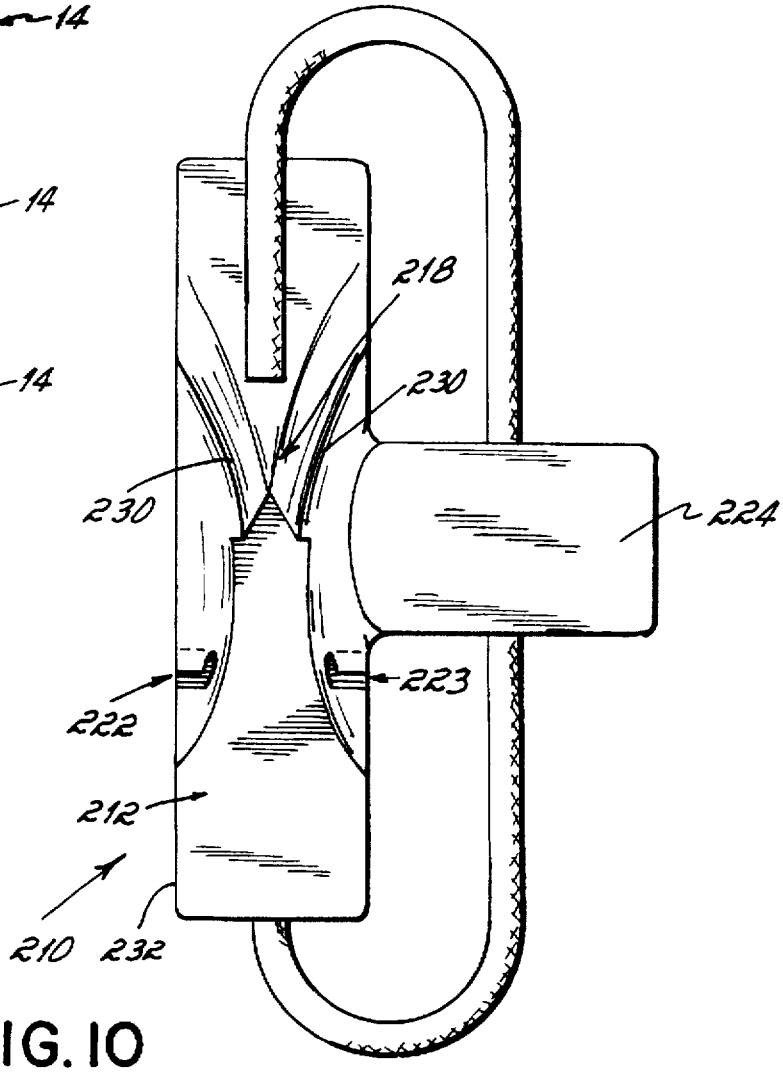
FIG. 10 is a perspective view of still another embodiment of a bundling device in accordance with the principles of the present invention.

FIG. 10 shows still another embodiment of a bundling device 210 in accordance with the principles of the present invention. In this embodiment, the handle 224 is generally perpendicular to the support member 212. A pair of walls 230 define a vertical wedge 218 oriented lengthwise of the support member 212. Two horizontal wedges 222 and 223 are formed in the walls 230, allowing the cord 214 to be routed in either direction and engaged in either horizontal wedge 222 or 223 after being engaged within the wedge 218. The cord 214 is integrally affixed to an end of the support member 212. If desired, the handle 224 may be eliminated and the end portion 232 of support member 212 may be employed as a handle.

Although various embodiments of the invention have been described in considerable detail, the invention is susceptible of modifications without departing from the scope of the invention. For example, the support member 12 may be made of one-piece construction, for instance by molding or casting, in which case the passages 42 may be omitted in favor of alternate means of securing additional fastening devices to the support member 12. Alternatively, member 12 may be made in two pieces designed to be snapped together by the manufacturer or by the user, rather than being joined by ultrasonic welding, gluing, or staking. Moreover, the invention is not limited to any particular number, configuration, or arrangement of wedges. For instance, although V-shaped and C-shaped wedges have been described, other cord-gripping structures may be used in accordance with the invention. The invention is also susceptible of a variety of uses, including, but not limited to, the bundling of cables, ropes, textiles, construction and manufacturing materials, printed materials such as books and leaflets, packaging materials such as cartons and bags, tools, apparel, and sporting equipment such as bicycling equipment, skis, golf equipment, camping gear, and the like. The bundling device of the present invention may also be incorporated into the structure of an item in place of a more conventional fastener such as a clasp, a clip, a strap, or the like, in order either to secure other objects to the item or to secure one part of the item to the remainder of the item. As an example of the former use, attachment of a water bottle to a bicycle may be accomplished by incorporating a device in accordance with the present invention into either the water bottle or the bicycle. As an example of the latter use, such a device may be incorporated into a book bag in place of a clasp or clip so that the top flap of the bag may be held in a closed position against the bag. The invention may also be incorporated into the structure of camping equipment, skis, a golf bag, and the like. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A device for securing a bundle, the device comprising:

a support member;

an elongated longitudinally stretchable and resilient cord extending between an end which is free and a point which is attached to the support member, the cord having an unstretched length and diameter and being stretchable under tension to increase in length and decrease in diameter, the unstretched length and diameter being restored upon release of the tension; and a pair of vertically-extending wedges on the support member, the wedges including opposed walls spaced apart to define a cord-receiving space therebetween, the cord-receiving space being narrower than the unstretched diameter of the cord, whereby the wedges are adapted to receive and secure the cord in a stretched condition wrapped around said bundle and engage the cord to hold the cord in said stretched and wrapped condition.

2. The device of claim 1, wherein the support member has a handle adapted to be gripped by a user.

3. The device of claim 1, wherein the cord has a longitudinally resilient core and a longitudinally resilient frictional cover surrounding the core.

4. The device of claim 3, wherein the longitudinally resilient core is solid.

5. The device of claim 4, wherein the solid core is constructed of a plurality of longitudinal strands.

6. The device of claim 4, wherein the solid core is of one-piece construction.

7. The device of claim 3, wherein the longitudinally resilient core is hollow.

8. The device of claim 1, wherein a first one of said wedges includes:

a pair of generally vertical walls integrally formed on the support member and spaced apart to define a cord-receiving channel therebetween, the wedge further including a pair of oppositely disposed edges formed in the vertical walls defining a cord-gripping space therebetween, the cord-gripping space being narrower than the unstretched diameter of the cord, the edges thereby engaging the cord to prevent the stretched cord from slipping longitudinally through the cord-gripping space.

9. The device of claim 8, wherein the first wedge includes a pair of generally horizontal walls defining the cord-receiving channel, and wherein there are two said edges defining a generally V-shaped cord-gripping space therebetween.

10. The device of claim 1, wherein a first one of said wedges is integrally formed with the upper surface of the support member, the first wedge including a generally horizontal cord-receiving channel, the cord-receiving channel having a width smaller than the unstretched diameter of the cord, the first wedge further including at least one edge formed in the channel and adapted to engage the stretched cord to prevent the cord from slipping through the channel.

11. The device of claim 10, wherein the first wedge is generally C-shaped in its vertically-extending cross-section.

12. The device of claim 1, wherein the support member has an internal passage therethrough for receiving a fastener, a first opening in the support member defining an entrance to the internal passage and a second opening in the support member defining an exit of the internal passage, whereby an end of a fastener may be threaded into the entrance, through the internal passage, and out the exit.

13. The device of claim 12, wherein the support member is of two-piece construction, with a one-piece upper member which includes a handle and the wedges, and a one-piece lower member joined to a lower surface of the upper member, the internal passage in the support member being defined between adjacent upper and lower surfaces of the lower and upper members, respectively.

14. A device for securing a bundle, the device comprising:

an elongated longitudinally resilient cord;

a support member adapted to receive and secure the cord, an end of the cord being free; and a wedge integrally formed on the support member and adapted to receive and secure the free end of the cord in a condition wrapped around said bundle, wherein the wedge includes: a pair of generally vertical walls integrally formed with an upper surface of the support member and spaced apart to define a cord-receiving channel therebetween, the wedge further including a pair of oppositely disposed edges formed in the vertical walls defining a cord-gripping space therebetween, the cord-gripping space being narrower than the unstretched diameter of the cord, the edges thereby engaging the cord to prevent the stretched cord from slipping longitudinally through the cord-gripping space.

15. A device for securing a bundle, the device comprising:

an elongated longitudinally resilient cord;

a support member adapted to receive and secure the cord, an end of the cord being free; and a wedge integrally formed on the support member and adapted to receive and secure the free end of the cord in a condition wrapped around said bundle, the wedge including a generally horizontal cord-receiving channel, the channel having a width smaller than the unstretched diameter of the cord, the channel further including at least one edge adapted to engage the stretched cord to prevent the cord from slipping through the channel.

16. The device of claim 14, wherein the support member includes a hole adapted to receive and secure one end of the cord, the hole having an inner surface with pressure tabs adapted to engage the cord and prevent the cord from being withdrawn from the hole.

17. The device of claim 14, wherein the support member has an internal passage therethrough adapted to receive a fastener.

18. The device of claim 14, wherein the support member has an upper surface which includes a handle adapted to be gripped by a user with a lower surface of the support member against said bundle.

19. The device of claim 18, wherein the support member is of two-piece construction, with an upper member which includes the wedge and handle, and a lower member adapted to be joined to a lower surface of the upper member.

20. The device of claim 14, wherein the cord has a longitudinally resilient core which is solid.

21. The device of claim 20, wherein the solid core is constructed of a plurality of longitudinal strands.

22. The device of claim 14, wherein the cord has a longitudinally resilient core which is hollow.

23. A method of securing a bundle, the method comprising:

grasping said bundle with a hand;

placing a support member adjacent to said bundle with a lower surface of the support member against said bundle, the support member including a longitudinally stretchable and resilient cord extending between an end which is free and a point which is attached to the support member, the cord having a unstretched length and diameter and being stretchable under tension to increase in length and decrease in diameter, the unstretched length and diameter being restored upon release of the tension, the support member further having a pair of vertically-extending wedges including opposed walls spaced apart to define a cord-receiving space therebetween, the cord-receiving space being narrower than the unstretched diameter of the cord, whereby the wedges are adapted to receive and secure the cord in a stretched condition and engage the cord to hold the cord in said stretched and wrapped condition;

holding the support member against said bundle;

longitudinally stretching and wrapping the free end of the cord around said bundle and the support member; and securing the free end of the cord in a wrapped position to a wedge.

24. A device for securing a bundle, the device comprising:

a generally elongated member having a body with a first end and a second end and elongated side edges extending therebetween;

an elongated longitudinally stretchable and resilient cord permanently affixed to the elongated member and extending from an elongated side edge of the body, the cord having a free end; and a wedge formed on the elongated member between the first and second ends and spaced from the second end to define a gripping area of the elongated member adjacent the second end, the wedge being adapted to receive and secure the cord in a condition stretched and wrapped around said bundle.

25. The device of claim 24, wherein the cord has a longitudinally resilient core and a longitudinally resilient frictional cover surrounding the core.

26. The device of claim 25, wherein the longitudinally resilient core is solid.

27. The device of claim 26, wherein the solid core is constructed of a plurality of longitudinal strands.

28. The device of claim 26, wherein the solid core is of one-piece construction.

29. The device of claim 25, wherein the longitudinally resilient core is hollow.

30. The device of claim 24, wherein said wedge includes:

a pair of generally vertical walls integrally formed on the support member and spaced apart to define a cord-receiving channel therebetween, the wedge further including a pair of oppositely disposed edges formed in the vertical walls defining a cord-gripping space therebetween, the cord-gripping space being narrower than the unstretched diameter of the cord, the edges thereby engaging the cord to prevent the stretched cord from slipping longitudinally through the cord-gripping space.

31. The device of claim 24, wherein said wedge includes:

a generally horizontal cord-receiving channel, the cord-receiving channel having a width smaller than the unstretched diameter of the cord, the wedge further including at least one edge formed in the channel and adapted to engage the stretched cord to prevent the cord from slipping through the channel.

32. The device of claim 31, wherein the wedge is generally C-shaped in vertical cross-section.

33. The device of claim 31, wherein said wedge includes a pair of generally horizontal walls defining the cord-receiving channel, and wherein there are two said edges defining a generally V-shaped cord-gripping space therebetween.

34. The device of claim 24, wherein the support member has an internal passage therethrough for receiving a fastener, a first opening in the support member defining an entrance to the internal passage and a second opening in the support member defining an exit of the internal passage, whereby an end of a fastener may be threaded into the entrance, through the internal passage, and out the exit.

35. The device of claim 34, wherein the support member is of two-piece construction, with a one-piece upper member which includes a handle and the wedge, and a one-piece lower member joined to a lower surface of the upper member, the internal passage in the support member being defined between adjacent upper and lower surfaces of the lower and upper members, respectively.

36. The device of claim 24, wherein the body of the elongated member defines a hole with projecting tabs, the cord being positioned in the hole with the tabs projecting into the cord.

37. The device of claim 24 wherein an end of the cord opposite the free end is positioned within the body.

38. A method of securing a bundle, the method comprising:

grasping said bundle with a hand;

placing a generally elongated support member adjacent to said bundle with a lower surface of the support member against said bundle, the support member having a body with a first end and a second end and elongated side edges extending therebetween, an elongated longitudinally stretchable and resilient cord having a free end and being permanently affixed to and extending from an elongated side edge of the support member, and a wedge on the support member between the first and second ends and spaced from the second end to define a gripping area of the support member adjacent the second end, the wedge being adapted to receive and secure the cord in a condition stretched and wrapped around said bundle;

holding the support member against said bundle using the gripping area;

longitudinally stretching and wrapping the free end of the cord around said bundle and the support member; and securing the free end of the cord in a wrapped position to the wedge.

39. The method of claim 38 wherein the body of the support member defines a hole with projecting tabs, the cord being positioned in the hole with the tabs projecting into the cord.

40. The method of claim 38 wherein an end of the cord opposite the free end is positioned within the body.

41. A method for securing a bundle, the method comprising:

grasping said bundle with a hand;

placing a generally elongated support member adjacent to said bundle with a lower surface of the support member against said bundle, the support member having an attached elongated longitudinally resilient cord, an end of the cord being free; the support member further having a wedge integrally formed on the support member and adapted to receive and secure the free end of the cord in a condition wrapped around said bundle, wherein the wedge includes a pair of generally vertical walls integrally formed with an upper surface of the support member and spaced apart to define a cord-receiving channel therebetween, the wedge further including a pair of oppositely disposed edges formed in the vertical walls defining a cord-gripping space therebetween, the cord-gripping space being narrower than the unstretched diameter of the cord, the edges thereby engaging the cord to prevent the stretched cord from slipping longitudinally through the cord-gripping space;

holding the support member against said bundle;

longitudinally stretching and wrapping the free end of the cord around said bundle and the support member; and securing the free end of the cord in a wrapped position to the wedge.

42. A method for securing a bundle, the method comprising:

grasping said bundle with a hand;

placing a generally elongated support member adjacent to said bundle with a lower surface of the support member against said bundle, the support member having an elongated longitudinally resilient cord permanently affixed thereto, an end of the cord being free; the support member further having a wedge integrally formed on the support member and adapted to receive and secure the free end of the cord in a condition wrapped around said bundle, the wedge including a cord-receiving channel, the channel having a width smaller than the unstretched diameter of the cord, the channel further including at least one edge adapted to engage the stretched cord to prevent the cord from slipping through the channel;

holding the support member against said bundle;

longitudinally stretching and wrapping the free end of the cord around said bundle and the support member; and securing the free end of the cord in a wrapped position to the wedge.

43. The method of claim 42 wherein the support member defines a hole with projecting tabs, the cord being positioned in the hole with the tabs projecting into the cord.

44. The method of claim 42 wherein an end of the cord opposite the free end is positioned within the body.

* * * * *

UNITED STATES PATENT AND TRADEMARK OFFICE

CERTIFICATE OF CORRECTION

PATENT NO. : 5,774,945

DATED : July 7, 1998

INVENTOR(S) : Mark H. Ginocchio

It is certified that error appears in the above-identified patent and that said Letters Patent is hereby corrected as shown below:

Column 1, line 7, before the word "number", insert --A--.

Signed and Sealed this

Twenty-second Day of June, 1999

*Attest:*

Q. TODD DICKINSON

*Attesting Officer*

*Acting Commissioner of Patents and Trademarks*